US010317063B2

(12) United States Patent
Ott et al.

(10) Patent No.: US 10,317,063 B2
(45) Date of Patent: Jun. 11, 2019

(54) EXPLOSION-PROOF LUMINAIRE

(71) Applicant: Eaton Protection Systems IP GmbH & Co. KG, Schönefeld (DE)

(72) Inventors: Toni Ott, Neckargemünd (DE); Jens Burmeister, Eberbach (DE)

(73) Assignee: EATON INTELLIGENT POWER LIMITED, Dublin (IE)

( * ) Notice: Subject to any disclaimer, the term of this patent is extended or adjusted under 35 U.S.C. 154(b) by 503 days.

(21) Appl. No.: 14/911,417

(22) PCT Filed: Aug. 13, 2013

(86) PCT No.: PCT/EP2013/002431

§ 371 (c)(1),
(2) Date: Feb. 10, 2016

(87) PCT Pub. No.: WO2015/021995

PCT Pub. Date: Feb. 19, 2015

(65) Prior Publication Data

US 2016/0186975 A1 Jun. 30, 2016

(51) Int. Cl.
*F21V 7/00* (2006.01)
*F21V 7/22* (2018.01)
(Continued)

(52) U.S. Cl.
CPC ..... *F21V 25/12* (2013.01); *F21V 7/0008* (2013.01); *F21V 7/22* (2013.01); *F21V 15/01* (2013.01);
(Continued)

(58) Field of Classification Search
CPC ..... F21V 7/0008; F21V 7/005; F21V 7/0058; F21V 7/22; F21V 25/12; F21V 31/00;
(Continued)

(56) References Cited

U.S. PATENT DOCUMENTS 5,365,411 A * 11/1994 Rycroft ..... G09F 13/14 362/20
9,200,759 B2 * 12/2015 Schwarz ..... F21V 7/0008
(Continued)

FOREIGN PATENT DOCUMENTS

CN 102032494 4/2011
CN 201944801 8/2011
(Continued)

OTHER PUBLICATIONS

Machine translation of CN102032494 via LexisNexis Total Patents, Feb. 9, 2017, 13 pages.
(Continued)

*Primary Examiner* — Erin Kryukova
(74) *Attorney, Agent, or Firm* — King & Spalding LLP

(57) ABSTRACT

The invention relates to an explosion-proof luminaire (1) comprising a luminaire housing (2), at least one light source (3) arranged in the luminaire housing (2), a reflective device (4) assigned to the light source (3) for deflecting light emitted by the light source (3) in the direction of a light exit opening (5) in the luminaire housing (2) and a cooling device (6) assigned to the light source (3) and/or the luminaire housing (2). In particular, an inner side (7) of the luminaire housing (2) is formed, at least pointwise, as a reflective device (4) and/or the cooling device (6) is formed in one piece with the luminaire housing (2).

20 Claims, 2 Drawing Sheets

(51) Int. Cl.

| | |
|---|---|
| ***F21V 15/01*** | (2006.01) |
| ***F21V 25/12*** | (2006.01) |
| ***F21V 29/00*** | (2015.01) |
| ***F21V 29/77*** | (2015.01) |
| ***F21V 31/00*** | (2006.01) |
| ***F21V 29/505*** | (2015.01) |
| ***F21V 29/507*** | (2015.01) |
| ***F21Y 103/10*** | (2016.01) |
| ***F21Y 103/33*** | (2016.01) |
| ***F21Y 115/10*** | (2016.01) |

(52) U.S. Cl.
CPC ..... *F21V 29/505* (2015.01); *F21V 29/507* (2015.01); *F21V 29/77* (2015.01); *F21V 31/00* (2013.01); *F21V 31/005* (2013.01); *F21V 7/005* (2013.01); *F21V 7/0058* (2013.01); *F21V 29/004* (2013.01); *F21Y 2103/10* (2016.08); *F21Y 2103/33* (2016.08); *F21Y 2115/10* (2016.08)

(58) Field of Classification Search
CPC .... F21V 31/005; F21V 29/507; F21V 29/505; F21V 17/06; F21V 15/01; F21V 15/013; F21Y 2103/33; F21Y 2103/10; F21Y 2115/10; F21S 41/29; F21K 9/66; F21K 9/62; G02F 1/133615; G02F 1/133608; G02B 6/0096
See application file for complete search history.

(56) References Cited

U.S. PATENT DOCUMENTS

| | | | | |
|---|---|---|---|---|
| 9,335,041 | B2 * | 5/2016 | Marquardt | F21V 33/006 |
| 9,605,814 | B2 * | 3/2017 | Kim | F21K 9/60 |
| 9,719,636 | B2 * | 8/2017 | Engelhardt | F21K 9/23 |
| 2005/0111222 | A1 * | 5/2005 | Olsson | B63B 45/02 362/267 |
| 2007/0263393 | A1 | 11/2007 | Van De Ven | |
| 2009/0034252 | A1 * | 2/2009 | Engel | F21S 8/04 362/235 |
| 2009/0243455 | A1 * | 10/2009 | Biebel | F21S 8/04 313/1 |
| 2010/0039821 | A1 * | 2/2010 | Oh | F21V 3/02 362/294 |
| 2010/0172152 | A1 * | 7/2010 | Boonekamp | F21V 7/0008 362/609 |
| 2010/0182782 | A1 * | 7/2010 | Ladewig | F21V 7/0008 362/235 |
| 2010/0277059 | A1 * | 11/2010 | Rains, Jr. | B82Y 30/00 313/502 |
| 2011/0002682 | A1 * | 1/2011 | Messina | F21V 7/0008 396/200 |
| 2011/0141731 | A1 * | 6/2011 | Chang | F21V 7/0008 362/235 |
| 2011/0199767 | A1 | 8/2011 | Marquardt et al. | |
| 2011/0222267 | A1 * | 9/2011 | Park | G02F 1/133615 362/97.1 |
| 2012/0081903 | A1 * | 4/2012 | Leung | F21V 7/0058 362/294 |
| 2012/0127756 | A1 * | 5/2012 | Kim | G02B 6/0055 362/612 |
| 2012/0162994 | A1 * | 6/2012 | Wasniewski | F21S 8/026 362/294 |
| 2013/0100651 | A1 * | 4/2013 | Doyle | F21L 4/00 362/158 |

FOREIGN PATENT DOCUMENTS

| | | |
|---|---|---|
| DE | 10 2010 037 920 | 4/2011 |
| WO | 2012105828 | 8/2012 |

OTHER PUBLICATIONS

Machine translation of CN201944801 via LexisNexis Total Patents, Feb. 9, 2017, 7 pages.
Translation of DE 10 2010 037 920 generated from Lexis Nexis Total Patents, 5 pages.
Menn, Patrick, European Patent Office, International Search Report issued in International Application No. PCT/EP2013/002431, completion date Mar. 31, 2014, dated Apr. 4, 2014, 6 pages.

* cited by examiner

EXPLOSION-PROOF LUMINAIRE

PRIORITY CLAIM

The present application is national phase application of and claims priority to International Application No. PCT/EP2013/002431 with an International filing date of Aug. 13, 2013. The foregoing application is hereby incorporated herein by reference.

TECHNICAL FIELD

The invention relates to an explosion-proof lamp comprising a lamp housing, at least one light source arranged in the lamp housing, a reflection device associated with the light source for deflecting light emitted by the light source in the direction of a light outlet opening of the lamp housing, and a cooling device associated with the light source and/or the lamp housing.

BACKGROUND

Such an explosion-proof lamp is known from DE 10 2011 017 161. A separate light reflection device is in this prior art lamp disposed within the lamp housing and composed of a plurality of linear and curved sections. Specific holding devices are formed within the lamp housing for this reflection device. The light source is furthermore configured as a printed circuit board with a number of LEDs arranged on a separate carrier. A cooling device is also formed on this carrier separate from the actual lamp.

Such a lamp is designed as being explosion-proof, where this explosion protection pertains in particular to a respective connection of components of the lamp, such connections being formed between the housing interior and the surroundings of the lamp.

SUMMARY

The invention is based on the object of improving such a lamp to the effect that the latter has a simpler structure, is easier to manufacture and generally more compact and more inexpensive while maintaining its specific properties for cooling and reflecting the light in the direction toward the light outlet opening.

The objective is satisfied by the features of claim 1. The explosion-proof lamp according to the invention is in particular characterized in that an inner side of the lamp housing is formed, at least in some locations, as a reflection device and/or the cooling device is formed in one piece with the lamp housing. In this way, no separate equipment needs to be disposed in the lamp or in the lamp housing, respectively, forming, for example, a reflection device and/or a cooling device. In a particularly preferred case, both devices can be formed directly by the lamp housing.

The respective reflection device can be formed directly by the inner side of the lamp housing when the latter is configured, for example, as a polished or otherwise reflective surface.

However, there is also the possibility that the reflection device is formed as a coating on the inner side. Such a coating can be applied directly during production of the lamp housing and is disposed directly on the inner side.

The lamp or the lamp housing, respectively, can be of varying shape which can be selectable depending on the field of application of the lamp. It can in a simple embodiment prove to be advantageous to have the lamp housing be formed to be substantially semi-cylindrical or hemispherical, where the reflection device is formed along the curved semi-cylindrical/hemispherical casing on its inner side.

It is of course also possible that not the entire inner side is formed as a reflection device, but only a portion of an inner side needed for deflecting the light emitted from the light source in the direction toward the light outlet opening.

In order to protect the lamp housing in its interior and in particular components disposed therein, such as the light source or the like, from contamination or the like, and, optionally, to not need any separate components within the lamp housing for respective explosion protection, the light outlet surface can be covered by a translucent or transparent cover plate. The cover by way of the cover plate can in the present case be effected such that the connection between the cover plate and the lamp housing is formed in a respective explosion protection class, for example, Ex-d.

Various kinds of light sources can be used in the explosion-proof lamp according to the invention, where the light source can preferably be formed by a plurality of LEDs disposed on a printed circuit board. The arrangement of several printed circuit boards with respective LEDs is of course also possible.

It can be seen to be a simple and effective arrangement for the cooling device when it the latter is formed on an outer side of the lamp housing.

It can in this context be advantageous if such a cooling device comprises a number of cooling fins protruding outwardly on the outer side of the lamp housing. These cooling fins can be spaced at equal distance to each other and it is also possible that the concentration of the cooling fins differs for increased cooling, for example, in particular the lamp housing in the region of the light source.

Production of the respective cooling fins can be simplified when they possibly have the same height and/or the same length. The cooling fins can in general extend over the entire length of the lamp housing.

In order to close openings by simple measures in particular in a semi-cylindrical lamp housing that are disposed on its opposite longitudinal ends, these openings can be covered by in particular detachable end cover plates fastened to the lamp housing. Also in this case, a respective connection between the cover plates and the lamp housing can be formed in compliance with an appropriate protection class, such as Ex-d.

Such type of ignition protection is also referred to as a pressure-resistant enclosure in which components that could ignite an explosive atmosphere are disposed in a housing that can withstand the respective explosion pressure following an explosion of an explosive mixture in the interior. Transferring the explosion to the atmosphere surrounding the housing is thereby prevented.

This means, there is indeed the possibility that an explosive atmosphere has penetrated the housing, however, transfer of the explosion to the exterior is in the event of an explosion within the housing prevented.

In order to dissipate the corresponding high gas pressure which can in this context during an explosion occur in the housing interior of the enclosed pressure-resistant housing, such housing is usually provided with gaps. A respective gap has two tasks. It firstly serves to reduce the gas pressure and it further serves to reduce the temperature of the explosion gas, so that an explosive atmosphere surrounding the enclosed pressure-resistant housing can not be ignited.

Respective gaps can be provided, for example, between components of the housing which are connected to each other, where such a gap extends from the housing interior to the surrounding atmosphere.

For easy fastening of the end cover plates, support flanges can protrude on either longitudinal end from the outer side of the lamp housing, where fastening screws can be passed through said support flanges for detachably fastening the oppositely disposed end cover plates.

The light source of the lamp can according to the invention be arranged on a separate carrier within the housing, where an arrangement can preferably be provided on the inner side of the lamp housing.

In order to arrange the lamp, for example, not directly on the curved inner side of a lamp housing, the inner side of the lamp housing can comprise at least one bearing flange protruding into the housing interior and being provided for detachable fastening of the light source.

In order to possibly be able to dispose the light source closely adjacent to the light outlet opening, such a bearing flange can extend along the light outlet opening.

In order to not need to fasten the cover plate directly on the lamp housing, a cover plate holder can be assignable to the light outlet opening, by use of which the cover plate can be fastened relative to the lamp housing, in particular complying with ignition protection class Ex-d.

In this manner, also the cover plate can be handled separately and without contact, since it is by way of the cover plate holder assignable to the light outlet opening and can be fastened there.

The cover plate holder can preferably comprise a placement flange that adjoins a holder opening and on which the cover plate can be placed.

In order to realize a respective ignition protection class for the explosion-proof lamp also at this location, a connection between the cover plate and the placement flange can be formed in particular in compliance with ignition protection class Ex-d.

However, it is also possible that the components are at this location directly adhesively bonded together, where, see the above explanations, where no respective gap is in this context formed between the components.

In order to be able to fasten the cover plate holder easily on the lamp housing in a simple manner, the cover plate holder can comprise an abutment flange facing outwardly from the placement flange and abutting in particular from beneath against the bearing flange while forming a connection, in particular in compliance with ignition protection class Ex-d.

In order to be able to both orient as well as easily arrange the cover plate on the cover plate holder, a separation rib can between the abutment flange and the placement flange protrude from the cover plate holder into the housing interior. This separation rib surrounds the cover plate and at the same time defines a respective recess into which the cover plate can be inserted and with which it can oriented.

In the foregoing embodiment, the placement flange and the abutment flange extend in the same direction and run substantially horizontally. However, it is also conceivable that an insertion flange protrudes from lateral ends of a placement flange in the direction toward the housing interior and is connectable to the inner side of the lamp housing, where this connection can be formed in particular in compliance with ignition protection class Ex-d.

If the housing is substantially hemispherical in shape, such an insertion flange can be formed as a screw-in ring, where a respective screw connection between the inner side of the lamp housing and an outer side of the screw-in ring can be effected in particular by an Ex-d thread.

In a hemispherical housing, it is possibly further advantageous if the printed circuit board with the LEDs is configured as a printed circuit board ring. The printed circuit board ring is then disposed according to its diameter in the hemispherical housing, so that, for example, the outer side of the printed circuit board ring abuts the inner side of the lamp housing.

However, it is also conceivable that the printed circuit board ring is mounted on the screw-in ring.

One option of such mounting can optionally be seen where the printed circuit board ring rests on an upper end of the screw-in ring. It is attached there in order to define its position.

It is in this context further possible that the printed circuit board ring is clamped between the upper end of the screw-in ring and a stepped shoulder formed on the inner side of the lamp housing when the screw-in ring is screwed into the lamp housing. This means that the printed circuit board ring is placed on the upper end of the screw-in ring and the latter is screwed into the lamp housing, where in its screwed-in position, clamping of the printed circuit board ring is effected between the upper end of the screw-in ring and the respective stepped shoulder on the inner side of the lamp housing.

A cooling device has above already been described which is formed on the outer side of the lamp housing by a number of cooling fins or the like. It is also conceivable that the cooling device is formed directly by the outer side of the lamp housing and possibly also by the cover plate holder, without cooling fins or the like being formed in this example.

BRIEF DESCRIPTION OF THE DRAWINGS

Advantageous embodiments of the invention are further explained below in detail by use of the figures appended in the drawing, where.

DETAILED DESCRIPTION OF EXAMPLE EMBODIMENTS

Figure 1:
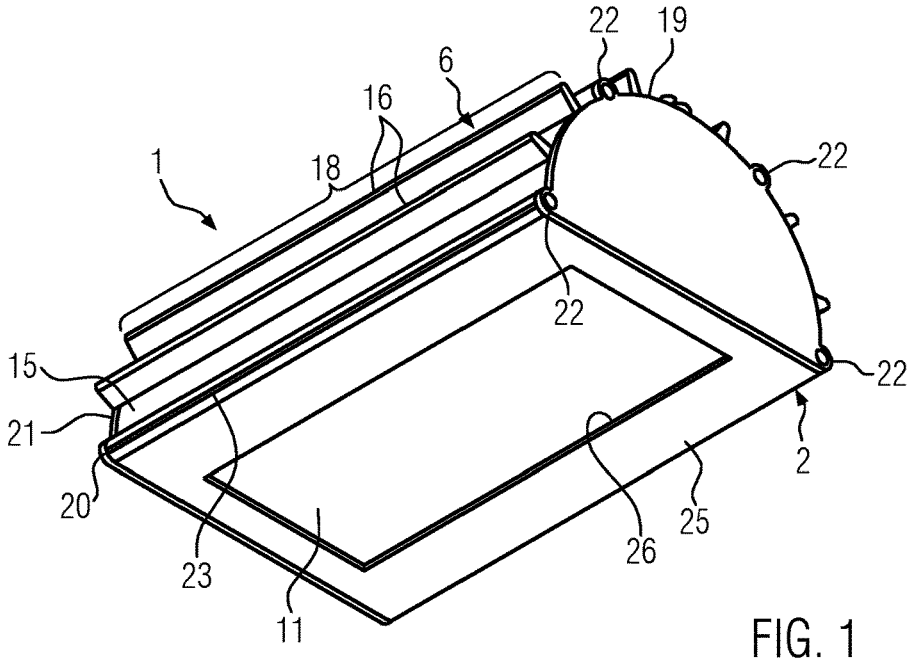
FIG. 1 shows a perspective view obliquely from below of a first embodiment of a lamp according to the invention.

FIG. 1 shows a perspective view obliquely from below onto a first embodiment of a lamp 1 according to the invention. It is substantially semi-cylindrical in shape with a respective semi-cylindrical casing 9 as part of lamp housing 2. On curved outer side 15 of lamp housing 2, a cooling device 6 is arranged in the form of a number of cooling fins 16 This cooling device 6 is formed in one piece with lamp housing 2. The respective cooling fins 16 extend over the entire length of lamp housing 2, see length 18, and in addition to having the same length, also have the same height 17, see FIG. 2.

Respective cooling fins 16 are disposed spaced substantially equally from each other, where other devices can protrude from outer side 15 of lamp housing 2 between the cooling fins. Such devices are, for example, support flanges 22 that protrude outwardly at longitudinal ends 19 and 20 of lamp housing 2. Support flanges 22 are used to receive and mount fastening screws 23. They are used to fasten end cover plates 21 which cover respective openings on longitudinal ends 19, 20 of lamp housing 2 and have a substantially semicircular shape.

Figure 2:
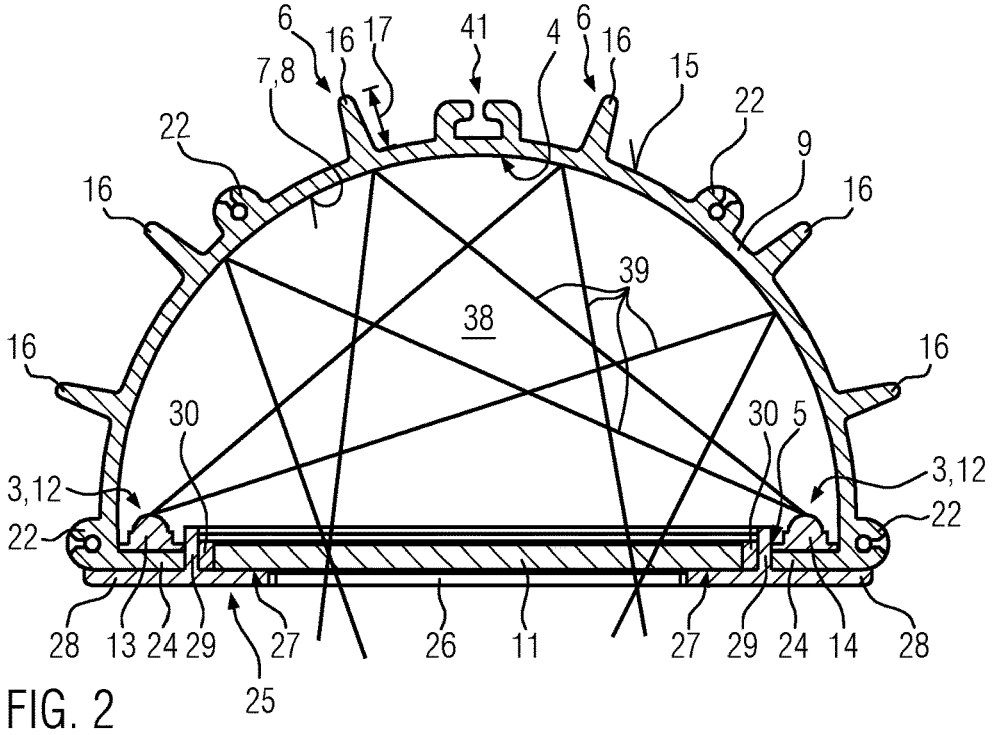
FIG. 2 shows a vertical sectional view through the lamp according to FIG. 1.

At a highest point of lamp housing 2, see also FIG. 2, a fastening device 41 is further arranged between two adjacent cooling fins, by use of which the lamp housing can be fastened in a respective installation position.

On an underside of lamp housing 2, a light outlet opening 5 is arranged which is in FIG. 1 partially covered by a cover plate holder 25. The latter comprises a support opening 26 which leaves a portion of light outlet opening 5 exposed. A cover plate 11 is visible in the holder opening 26 and held in an explosion-proof manner by cover plate holder 25 on lamp housing 2.

FIG. 2 shows a vertical sectional view through lamp 1 according to FIG. 1.

The respective cooling device 6 in the embodiment illustrated comprises six cooling fins 16 of the same height 17 and the same length 18. They extend directly outwardly from outer side 15 of lamp housing 2. On an inner side 7 of lamp housing 2, a reflection device 4 is formed It can also be formed by a coating 8 which is applied directly to inner side 7 of lamp housing 2.

Reflection device 4 can be applied to the entire inner side at least in the region of the respective semi-cylindrical casing 9. However, it is also possible that reflection device 4 is arranged only at locations of the inner side which are needed for reflection of light emitted from a light source 3 in the direction toward light outlet opening 5. In the embodiment illustrated, light sources 3 are arranged on either side of light outlet opening 5. Each of the light sources comprises a printed circuit board 13 or 14 with a plurality of LEDs 12 arranged thereon. The corresponding printed circuit board with LEDs can extend over the entire length of lamp housing 2.

At least some of the light beams 39 are shown in FIG. 2 emitted from respective LEDs 12 and being reflected by reflection device 4 in the direction toward light outlet opening 5.

Respective light sources 3 are arranged on bearing flanges 24, which are as part of lamp housing 2 disposed at the lower ends of semi-cylindrical casing 9 facing each other and defining light outlet opening 4. The respective bearing flanges 24 also extend substantially over the entire length of lamp housing 2.

Bearing flanges 24 form longitudinal edges of light outlet opening 5, where cover plate holder 25 with separation ribs 29 protruding into the housing interior 38 is inserted into the light outlet opening. These separation ribs 29 extend substantially vertically relative to a placement flange 27 and an abutment flange 28 Placement flange 27 defines holder opening 26 on either side and cover plate 11 is placed on placement flange 27 from inside housing 38. Furthermore, a seal 30 is arranged between separation ribs 29 and lateral edges of cover plate 11.

A similar connection between placement flange 27 and cover plate 11 is effected to provide a respective explosion protection of the ignition protection class Ex-d. A corresponding connection with this ignition protection class is also formed between abutment flange 28 bearing flange 24. It is at least for the connection between placement flange 27 and cover plate 11 also possible that adhesive bonding occurs there. In this case, cover plate holder 25 would together with cover plate 11 and seal 30 be a separately manageable component which is jointly attachable on lamp housing 2 by an appropriate connection between abutment flange 28 and bearing flange 24.

To improve cooling, in particular of respective light sources 3, printed circuit board 13, 14 is usually in direct contact with bearing flange 24. However, it is also conceivable that a heat transfer layer is formed between the two, such as heat-conductive paste or the like.

First heat dissipation from LEDs 12 can occur via the printed circuit board. There are a number of options for this. For example, special printed circuit board shapes can be used which exhibit particularly good thermal conductivity, such as printed circuit boards having a metal core. The heat of the LEDs can be passed, for example, to the metal core via a copper through-contact. The heat can then from the metal core be passed on directly to the lamp housing. Thermal conductivity can in this context be improved by heat-conductive paste or the like. Moreover, it is in this context of advantage if respective heat transfer is improved by mounting the printed circuit board without the surfaces to be joined being uneven and rough.

Figure 3:
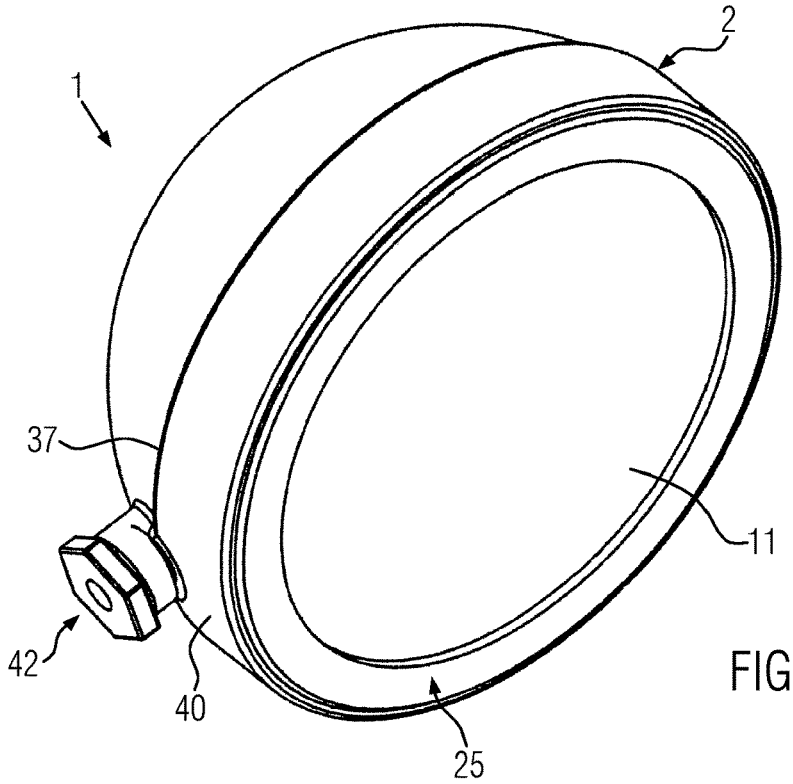
FIG. 3 shows a perspective view obliquely from below onto a second embodiment of a lamp according to the invention.

It should at this stage be pointed out again that Ex-d or pressure-resistant enclosure is a type of ignition protection in which the components that can ignite an explosive atmosphere are disposed within a housing, for example, see FIGS. 1 and 3. This housing withstands an internal pressure which might arise during explosion of an explosive mixture within the housing. The housing is provided with respective gaps, for example, see a respective gap between bearing flange 24 and abutment flange 28. A respective gap can also be formed between cover plate 11 and placement flange 27, though adhesive bonding is in this case a connection option.

FIG. 3 shows a perspective view obliquely from below onto a second embodiment of a lamp 1 according to the invention. It has a hemispherical shape with a corresponding hemispherical casing 10 as part of lamp housing 2. The diameter of the hemispherical casing 10 is in a lower end portion 40 somewhat enlarged in order to be able to there arrange the respective cover plate holder 25, see also FIG. 4.

A cable feed-through fixture 42 protrudes laterally from lamp housing 2, through which a respective electrical power line can bin run in an explosion-proof manner into housing interior 38.

Figure 4:
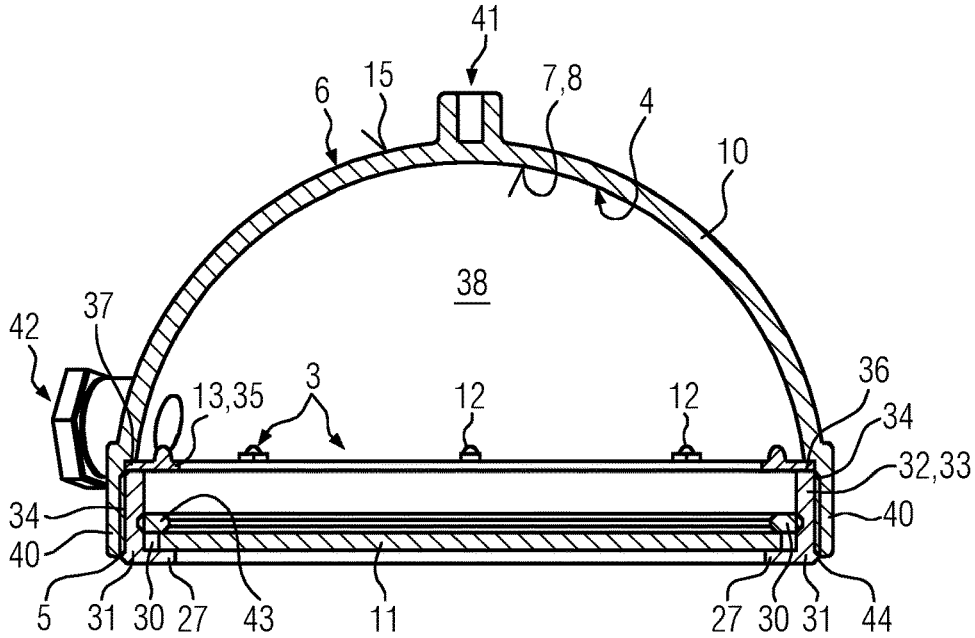
FIG. 4 shows a vertical sectional view through the lamp according to FIG. 3.

Similar to lamp housing 2 of FIG. 2, a fastening device 41 is formed at the upper end of lamp housing 2 according to FIG. 4. Cooling device 6 is also in lamp housing 2 according to FIGS. 3 and 4 formed by lamp housing 2, where, however, outer side 15 of lamp housing 2 presently directly forms the respective cooling device 6.

In analogy to the first embodiment, reflection device 4 is formed on an inner side 7 of lamp housing 2.

Between lower end portion 40 and the remaining part of lamp housing 2, a stepped shoulder 37 is formed, see also FIG. 4, which together with an upper end 36 of an insertion flange 32 of cover plate holder 25 serves to clamp a respective printed circuit board 13, 14 with LEDs 12 as light source 3.

Due to the specific shape of lamp housing 2 in the second embodiment, printed circuit board 13, 14 is designed as a fully circumferential printed circuit board ring 35. It is at its outer edge clamped in the manner described above.

Respective LEDs 12 are arranged along printed circuit board ring 30 and a respective opening in printed circuit board ring 35 is associated with light outlet opening 5. It is encompassed by lower end portion 40.

For arranging a respective cover plate 11 in the region of light outlet opening 5, a cover plate holder 25 is also used in the second embodiment. The latter in analogy to the first embodiment comprises a radially inwardly protruding placement flange 27, on which cover plate 11 is placeable from the top, i.e. from housing interior 38. In analogy to separation rib 29 according to the first embodiment, cover plate holder 25 on lateral outer ends 31 of placement flange 27 comprises insertion flange 32 that faces into housing interior 38. Disposed between the latter and cover plate 11 is a seal 30. A fastening ring 43 can additionally be provided, by which cover plate 1 is pushed in the direction toward placement flange 27 and held in abutment with placement flange 27.

Insertion flange 32 is in an advantageous manner formed as a screw-in ring 33, where between the latter and in particular its outer side and an inner side of lower end portion 40 an Ex-d-thread 34 is formed. It is used for screwing screw-in ring 33 into lower end portion 40 of lamp housing 2 in a simple manner and at the same time for achieving a connection of the respective explosion protection class.

The respective screw-in depth of screw-in ring 33 can be determined by edge flange 44 at the latter's lower end protruding outwardly, which in a screwed-in position of printed circuit board ring 35, see FIG. 4, abuts end portion 40 substantially from below.

It has already been pointed out that an outer edge of printed circuit board ring 35 is clamped between upper end 36 of printed circuit board ring 35 and stepped shoulder 37, whereby printed circuit board ring 35 is fixed in its position.

A connection between cover plate 11 and placement flange 27 can in a second embodiment be created, for example, by adhesive bonding.

The lamp according to the invention has a simple and integrated arrangement of the reflection device and the cooling device. Reflection device 4 is in each case realized directly by a respective inner side 7 of lamp housing 2, where a coating 8 can additionally be applied to the inner side. Cooling device 6 is formed directly and in one piece by outer side 15 of lamp housing 2, where the outer side can for enhancing the cooling effect have respective cooling fins.

Configuration of the lamp is according to the invention effected in an explosion-proof manner, for which purpose in particular a respective cover plate holder 25 is provided between which and in particular the cover plate a respective explosion-proof connection is realized. This can be done by a respective gap or by an adhesive bond. The respective type of explosion protection is also realized in that, for example, a respective fastening ring 43, see FIG. 4, is additionally used.

Additional fastening elements, such as screws or the like, are also possible in order to fasten cover plate holder 25, for example, in the embodiment according to FIG. 2, to lamp housing 2.

Furthermore, it is to be noted that cover plate holder 25, in addition to cooling by way of lamp housing 2, can assume a further cooling function, so that in particular dissipation of heat to the exterior can take place directly from the printed circuit board via cover plate holder 25. The respective cooling elements are formed from suitable materials, such as metals, thermally conductive plastic materials, ceramics or the like.

It should also be noted that, for example, in the first embodiment according to FIGS. 1 and 2, the arrangement of the respective light source is effected directly via lamp housing. 2. In the second embodiment according to FIGS. 3 and 4, the arrangement and fixation is effected not only by the lamp housing, but in combination with screw-in ring 33 as part of cover plate holder 25.

The invention claimed is:

1. An explosion-proof lamp comprising:

a lamp housing that defines a light outlet opening and comprises an inner side, said inner side of the lamp housing defining a housing interior;

at least one light source arranged in said lamp housing;

a reflection device associated with said at least one light source for deflecting light emitted by said at least one light source in a direction of said light outlet opening of said lamp housing;

a cooling device associated with said lamp housing, wherein said inner side of said lamp housing is formed, at least in some locations, as said reflection device, wherein said cooling device and said reflection device are integral with and formed in one piece with said lamp housing, and wherein said light outlet opening is covered by a cover plate that is translucent or transparent;

a cover plate holder that is assigned to said light outlet opening, said cover plate holder coupled to said lamp housing to fasten said cover plate to said lamp housing such that said coupling of said cover plate holder and said cover plate with said lamp housing is compliant with ignition protection class Ex-d, wherein said cover plate holder comprises:

a placement flange that defines and adjoins a holder opening, wherein said cover plate is placed on and supported by said placement flange such that at least a portion of said cover plate covers said holder opening, and an insertion flange that protrudes from a lateral end of said placement flange, wherein the insertion flange extends in a direction toward said housing interior and connects to said inner side of said lamp housing when said cover plate holder is coupled to the lamp housing; and a printed circuit board ring having a first surface and a second surface that is opposite to said first surface, wherein said at least one light source is disposed on said first surface of said printed circuit board ring, and wherein when the cover plate holder is coupled to the lamp housing, said printed circuit board ring is clamped between an upper end of said insertion flange and a stepped shoulder formed on said inner side of said lamp housing such that said second surface of said printed circuit board ring engages said upper end of said insertion flange and said first surface of said printed circuit board ring engages said stepped shoulder.

2. The explosion-proof lamp according to claim 1, characterized in that said reflection device is formed as a coating of said inner side.

3. The explosion-proof lamp according to claim 1, characterized in that said lamp housing is formed to be a substantially semi-cylindrical or hemispherical casing, where said reflection device is formed along a curved portion of said casing on said inner side.

4. The explosion-proof lamp according to claim 1, characterized in that said cooling device is formed on an outer side of said lamp housing that is opposite said inner side.

5. The explosion-proof lamp according to claim 1, characterized in that said cooling device comprises a number of cooling fins protruding outwardly from an outer side of said lamp housing that is opposite said inner side.

6. The explosion-proof lamp according to claim 5, characterized in that said cooling fins have a same height and/or length.

7. The explosion-proof lamp according to claim 1, characterized in that openings at oppositely disposed longitudinal ends of said lamp housing are covered by end cover plates that are detachably fastened to said lamp housing.

8. The explosion-proof lamp according to claim 7, characterized in that support flanges protrude on either of said longitudinal ends from an outer side of said lamp housing, through which fastening screws can be passed for detachably fastening said oppositely disposed end cover plates.

9. The explosion-proof lamp according to claim 1, characterized in that said at least one light source is disposed on said inner side of said lamp housing.

10. The explosion-proof lamp according to claim 1, characterized in that a connection between said cover plate and said placement flange is configured in compliance with ignition protection class Ex-d.

11. The explosion-proof lamp according to claim 10, characterized in that the connection between said cover plate and said placement flange is formed by adhesive bonding.

12. The explosion-proof lamp according to claim 1, characterized in that said connection between said insertion flange and said inner side of said lamp housing is formed in compliance with ignition protection class Ex-d.

13. The explosion-proof lamp according to claim 1, characterized in that said insertion flange is formed as a screw-in ring, where a screw connection between said inner side of said lamp housing and an outer side of said screw-in ring is affected by an Ex-d thread.

14. The explosion-proof lamp according to claim 13, characterized in that said printed circuit board ring is mounted on said screw-in ring.

15. The explosion-proof lamp according to claim 13, wherein said screw-in ring is screwed into said lamp housing.

16. The explosion-proof lamp according to claim 1, characterized in that said cooling device is formed by an outer side of said lamp housing.

17. An explosion-proof lamp comprising:

a lamp housing that defines a light outlet opening and comprising an inner side and an outer side that is opposite to the inner side, said inner side of the lamp housing defining a housing interior;

at least one light source arranged in said lamp housing, wherein said inner side of said lamp housing comprises a bearing flange protruding into said housing interior, and wherein said bearing flange is configured to detachably fasten said at least one light source to the lamp housing;

a reflection device defined by the inner side and associated with said at least one light source for deflecting light emitted by said at least one light source in a direction of said light outlet opening of said lamp housing;

a cooling device defined by said outer side, wherein said cooling device and said reflective device are integrally formed with said lamp housing such that said reflective device, said cooling device, and said lamp housing are one piece, and a cover plate holder that is separate from said lamp housing and assigned to said light outlet opening, said cover plate holder coupled to said lamp housing to couple a cover plate to said lamp housing such that:

(a) said coupling of said cover plate holder and said cover plate with said lamp housing is compliant with ignition protection class Ex-d, and (b) at least a portion of said cover plate covers the light outlet opening, and wherein said cover plate holder comprises a placement flange that defines and adjoins a holder opening, wherein said cover plate is placed on and supported by said placement flange such that at least a portion of said cover plate covers said holder opening, and wherein said cover plate holder comprises an abutment flange facing outwardly from said placement flange and abutting from beneath against said bearing flange while forming a connection that is in compliance with ignition protection class Ex-d.

18. The explosion-proof lamp according to claim 17, wherein said bearing flange extends along said light outlet opening.

19. The explosion-proof lamp according to claim 17, wherein a separation rib is disposed between said placement flange and said abutment flange, wherein the separation rib protrudes substantially perpendicular from said cover plate holder, and wherein the separation rib extends into said housing interior when the cover plate holder is coupled to the lamp housing.

20. The explosion-proof lamp according to claim 19, characterized in that a seal is disposed between said separation rib of said cover plate holder and said cover plate.

* * * * *